United States Patent [19]

Sattler

[11] Patent Number: 4,787,621

[45] Date of Patent: Nov. 29, 1988

[54] SHEET STACKING DEVICE WITH SUBDIVIDED BOUNDARY PLATES

[75] Inventor: Peter Sattler, Zwingenberg, Fed. Rep. of Germany

[73] Assignee: Valmet Strecker GmbH, Fed. Rep. of Germany

[21] Appl. No.: 3,759

[22] Filed: Jan. 16, 1987

[30] Foreign Application Priority Data

Jan. 17, 1986 [DE] Fed. Rep. of Germany ..... 3601294

[51] Int. Cl.[4] ..... B65H 31/20; B65H 31/38

[52] U.S. Cl. ..... 271/221; 271/224; 414/35; 414/36; 414/900

[58] Field of Search ..... 414/35, 36, 113, 900; 271/171, 221, 222, 223, 224, 299

[56] References Cited

U.S. PATENT DOCUMENTS

| | | | |
|---|---|---|---|
| 1,457,094 | 5/1923 | Thompson et al. | 271/105 |
| 2,785,893 | 3/1957 | Ford et al. | 271/223 X |
| 2,992,823 | 7/1961 | Forrester | 271/222 |
| 3,382,966 | 5/1968 | Califano et al. | 414/35 |
| 3,617,052 | 11/1971 | Buccicone | 271/224 X |
| 3,977,671 | 8/1976 | Taylor et al. | 414/36 X |
| 4,097,042 | 6/1978 | Rozga | 271/224 X |
| 4,099,711 | 7/1978 | Grody et al. | 414/35 X |
| 4,484,736 | 11/1984 | Osburg et al. | 414/36 X |
| 4,509,740 | 4/1985 | Foresi et al. | 271/220 |

FOREIGN PATENT DOCUMENTS 1906696 9/1970 Fed. Rep. of Germany .

*Primary Examiner*—Leslie J. Paperner

*Attorney, Agent, or Firm*—Leydig, Voit & Mayer

[57] ABSTRACT

A sheet stacking device with a lift table automatically lowerable in correspondence to the height of the rising stack. At the upper end of the stack is a face-side sheet feeder and at least one stop late positioned opposite the sheet feeder and at least two lateral boundary plates lying opposite one another. The effective boundary plate length is adjustable to accommodate different sheet format lengths by subdividing the boundary plates into a plurality of individual sections in longitudinal directions, of which at least those remote from the stop plate are removable from the stacking zone. Preferably, the boundary plate sections are constructed as equally spaced tongues which are arrestable in a raised position with a support beam.

13 Claims, 5 Drawing Sheets

SHEET STACKING DEVICE WITH SUBDIVIDED BOUNDARY PLATES

FIELD OF THE INVENTION

The present invention relates generally to sheet stacking devices, and more particularly to sheet stacking devices which are adjustable to accommodate sheets of different sizes.

BACKGROUND OF THE INVENTION

It is a well known practice in the paper industry to construct sheet stacking devices connected to cross cutters which can be set for different sheet formats. It is a highly desirable feature of such stacking devices to stack sheets in such a manner as to result in stacks with very square edges, especially in the application of multicolor printing. Typically, lateral boundary plates are constructed as shaking plates and are mounted on a transversely shiftable support beam. So as to insure that the individual sheets in the stack lie exactly flush upon each other, the boundary plates are adjusted so as to enclose the sheets from both sides and extend as far as possible toward both ends of the stack. In the event of a format shortening of the sheets to be stacked, the lateral boundary plates must be changed accordingly so as to not interfere with the sheet feed means. Such boundary plate changes prove to be troublesome and excessively time-consuming, particularly in applications which involve a relatively frequent change of sheet format.

It is an object of the present invention to provide a sheet stacking device capable of being adjusted expediently and conveniently to accommodate different format sheets, while still assuring faultless alignment of the stack.

It is another object of the present invention to provide a sheet stacking device which is automatically adjustable to accommodate different sheet format sizes.

The above objects are realized in accordance with the present invention by providing a sheet stacking device with lateral boundary plates subdivided into individual sections. These individual sections are further individually and easily removable from the stacking zone so as to provide a convenient means for adjusting the effective boundary plate length to correspond to the particular sheet format length. Individual boundary plate sections are preferably removed from the stacking zone by being lifted up and secured in this raised position, avoiding any interference with the sheet feed means and stacking process.

BRIEF DESCRIPTION OF THE DRAWINGS

These and other objects of the invention will become apparent from the description below when taken in conjunction with the following drawings in which.

While the invention will be described in connection with certain preferred embodiments, it will be understood that it is not necessarily intended to limit the invention to those particular embodiments. On the contrary, it is intended to cover all alternatives, modifications and equivalents as may be included in the spirit and scope of the invention as defined by the appended claims.

DETAILED DESCRIPTION OF THE PREFERRED EMBODIMENT

Figure 1:
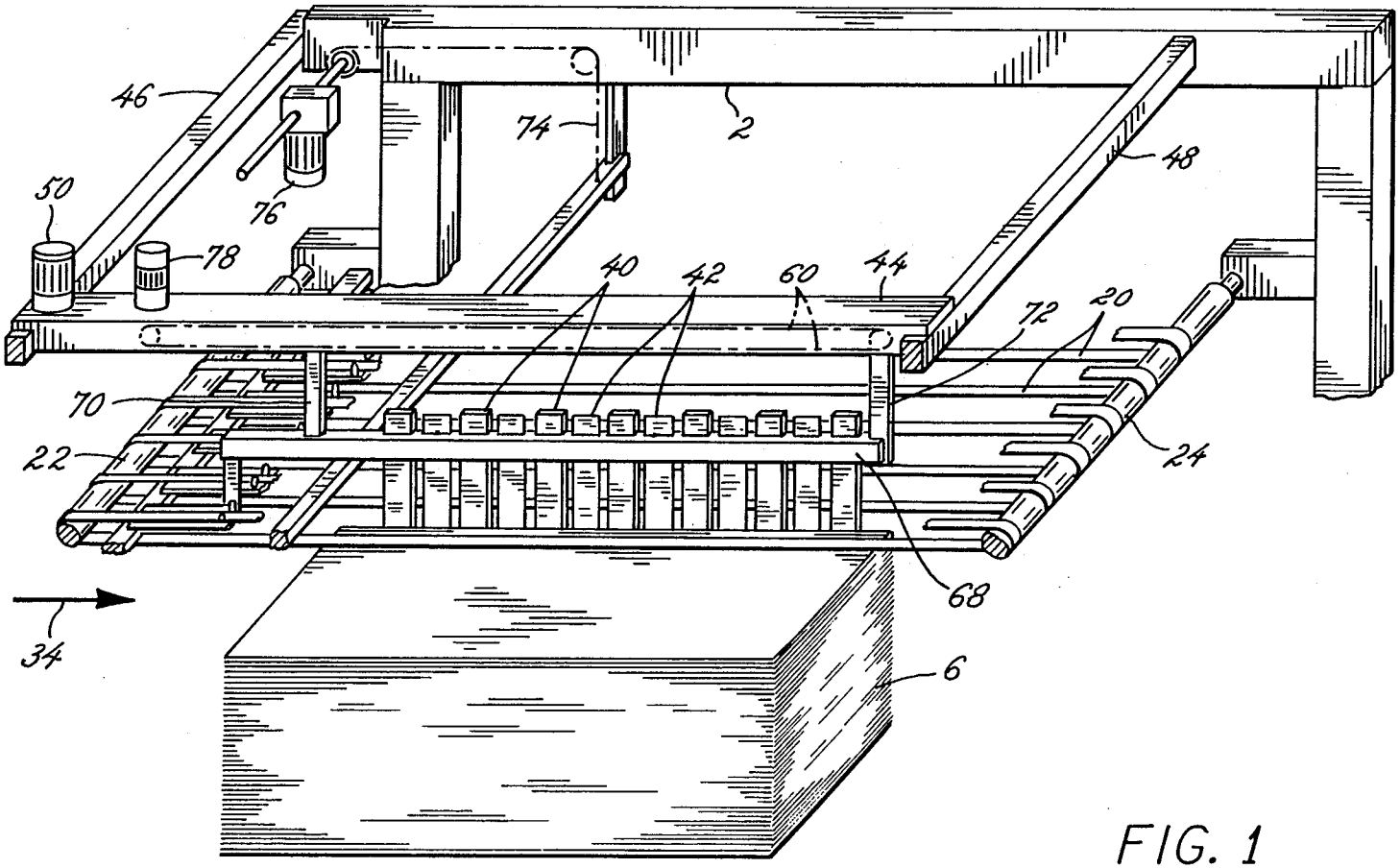
FIG. 1 is a perspective view depicting the formation and suspension of the subdivided lateral boundary plates.
Figure 2:
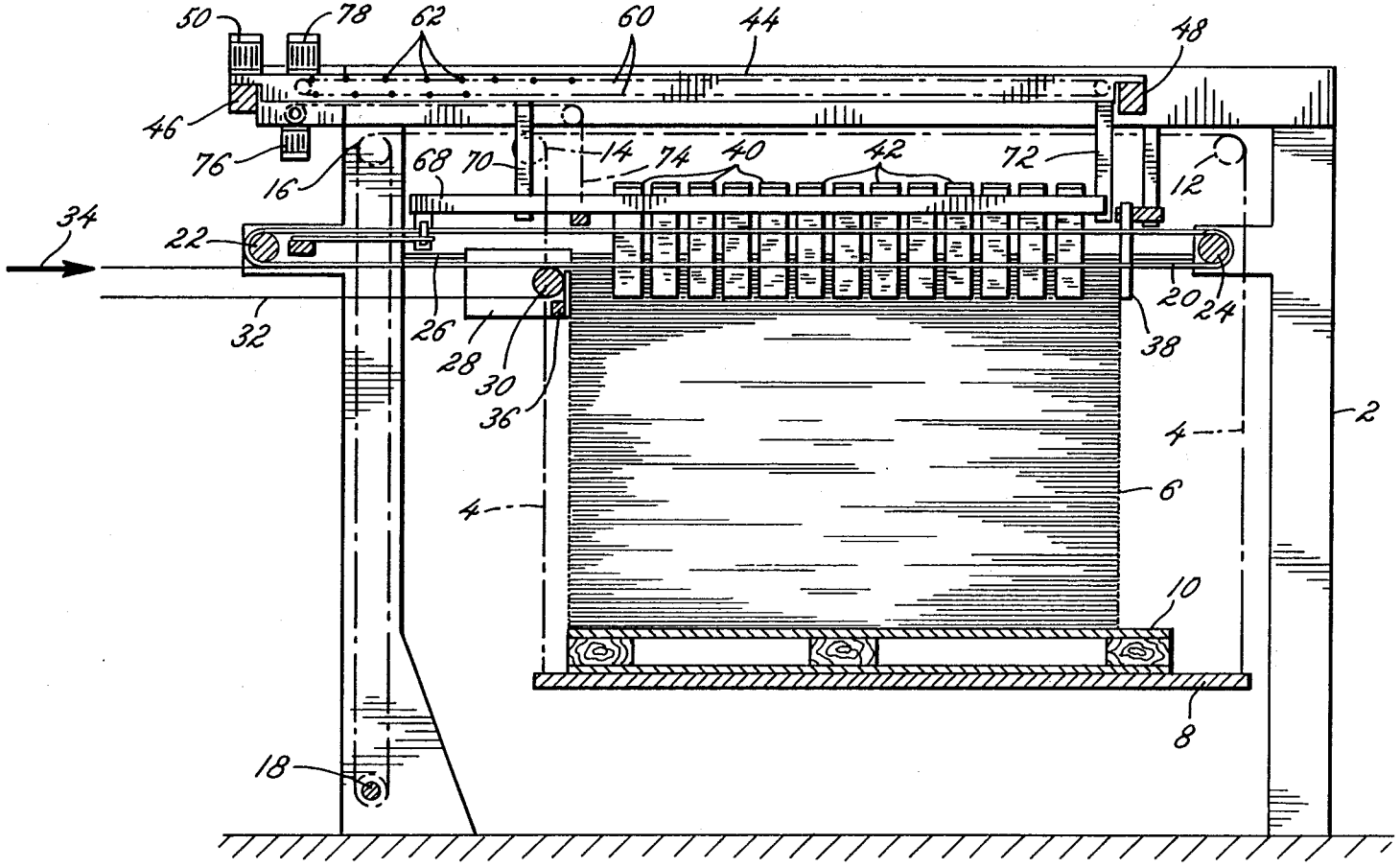
FIG. 2 is a schematic side view of a sheet stacking device in accordance with the present invention with approximately the largest possible stacking length.
Figure 3:
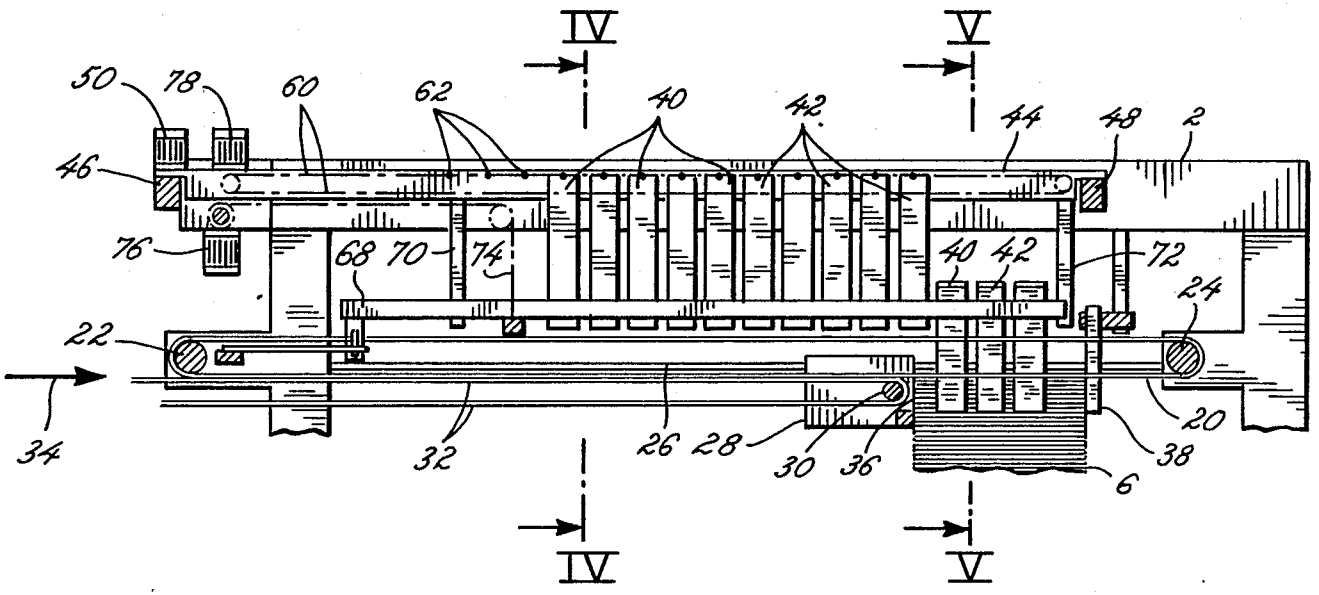
FIG. 3 is a schematic side view of the same sheet stacking device of FIG. 2 which has been adjusted to accommodate a shorter stacking length.

Turning now to the drawings, FIGS. 1 through 3 show the present invention in the form of the preferred embodiment. The frame 2 of the stacking device supports chains 4 from which is suspended a lift table 8 which is automatically lowerable in correspondence with the growth of the sheet stack 6. The sheets are stacked and rest on a pallet 10 which is carried by the lift table 8. The chains 4 are guided over rolls 12, 14, 16 and 18, of which the latter are drivable in a conventional manner by a motor (not shown) in correspondence with an automatic stack level sensing device so that the upper end of the stack 6 always remains at about the same height and constitutes the stacking zone.

Extending in a longitudinal direction over the entire length of the stack 6 is an upper set of endless adjacently lying sheet guide bands 20 which are conducted about two rollers 22 and 24 located in front and behind the stack and are driven from the roller 22. A plurality of longitudinally running rods 26 attached to the frame 2 provide a slidable mounting for blocks 28 to which a roller 30 is attached. Around the roller 30 runs a lower set of endless adjacently lying sheet feed bands 32.

The upper 20 and lower 32 sets of sheet feed bands are run in a direction so that between the lower portion of the set of upper feed bands and the upper portion of the set of lower sheet feed bands, individual sheets are fed in the direction of the arrow 34 to the top of the stack 6. Attached to the blocks 28 and immediately adjacent to the roller 30 is a rear contact plate 36 for the stack. On the front end of the stack 6 is a corresponding stop plate 38 mounted horizontally in the frame 2.

Instead of conventional continuous lateral boundary plates, the present invention provides a set of boundary plates which are subdivided into individual sections taking the form of alternating rigid 40 and flexible 42 tongues. The adjacently lying tongues 40 and 42 are suspended vertically on a support beam 44 and may be guided up and down upon it. Typically, a sheet stacker will contain several support beams 44 and sets of lateral boundary plates so as to allow for the simultaneous stacking of several different stacks of sheets. For adjustment to sheets of different sheet format widths, a drive 50 is used to move the support beams 44 in a lateral direction on transversely running rails 46 and 48 which are attached to the frame 2. The upper portion of the stack 6 is known as the stacking zone and is the area, when the device is in operation, where the sheets which are successively brought in by the bands 20 and 32 have not yet finally come to rest. The rear contact plate 36, the stop plate 38, and the sets of tongues 40 and 42 acting as lateral boundary plates, then substantially encompass the stacking zone.

Figure 4:
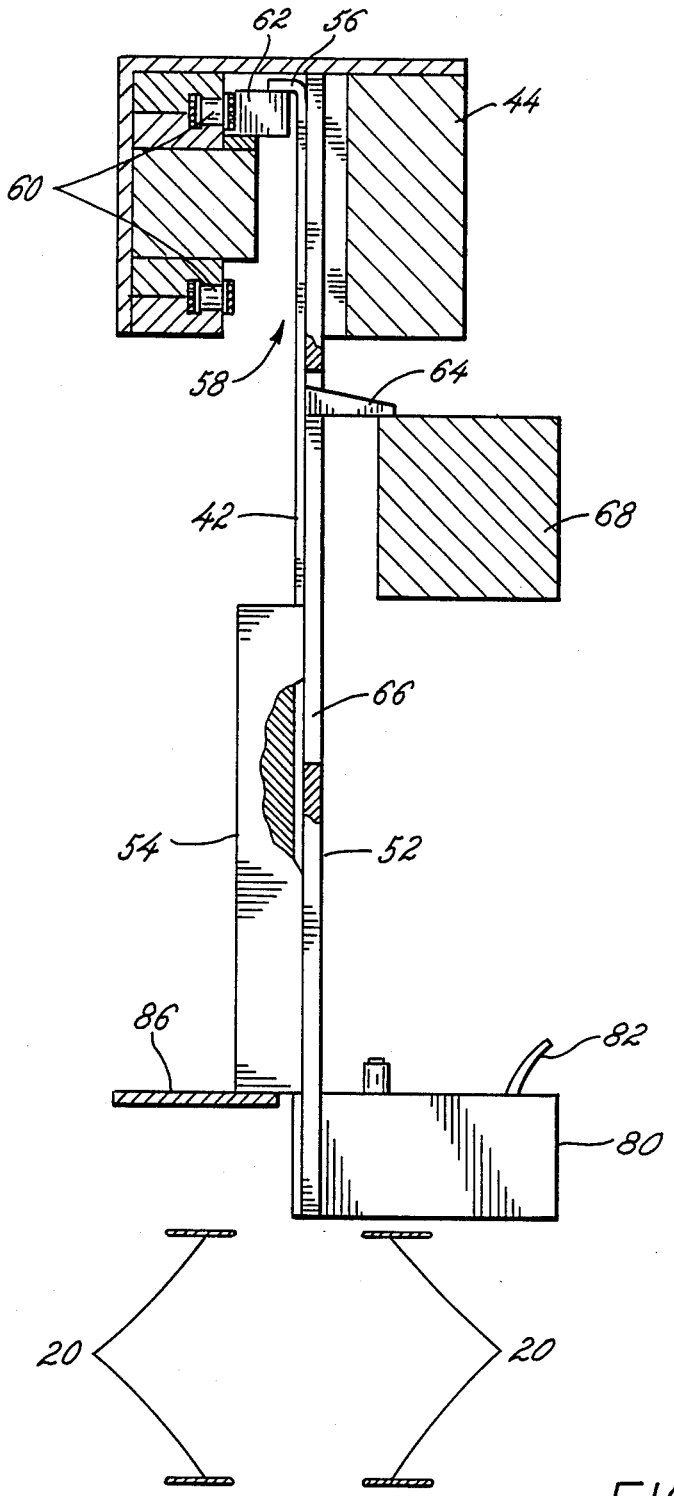
FIG. 4 is an enlarged cross-sectional view depicting the suspension of an individual boundary plate section its raised position, corresponding to the section line IV—IV of FIG. 3.
Figure 5:
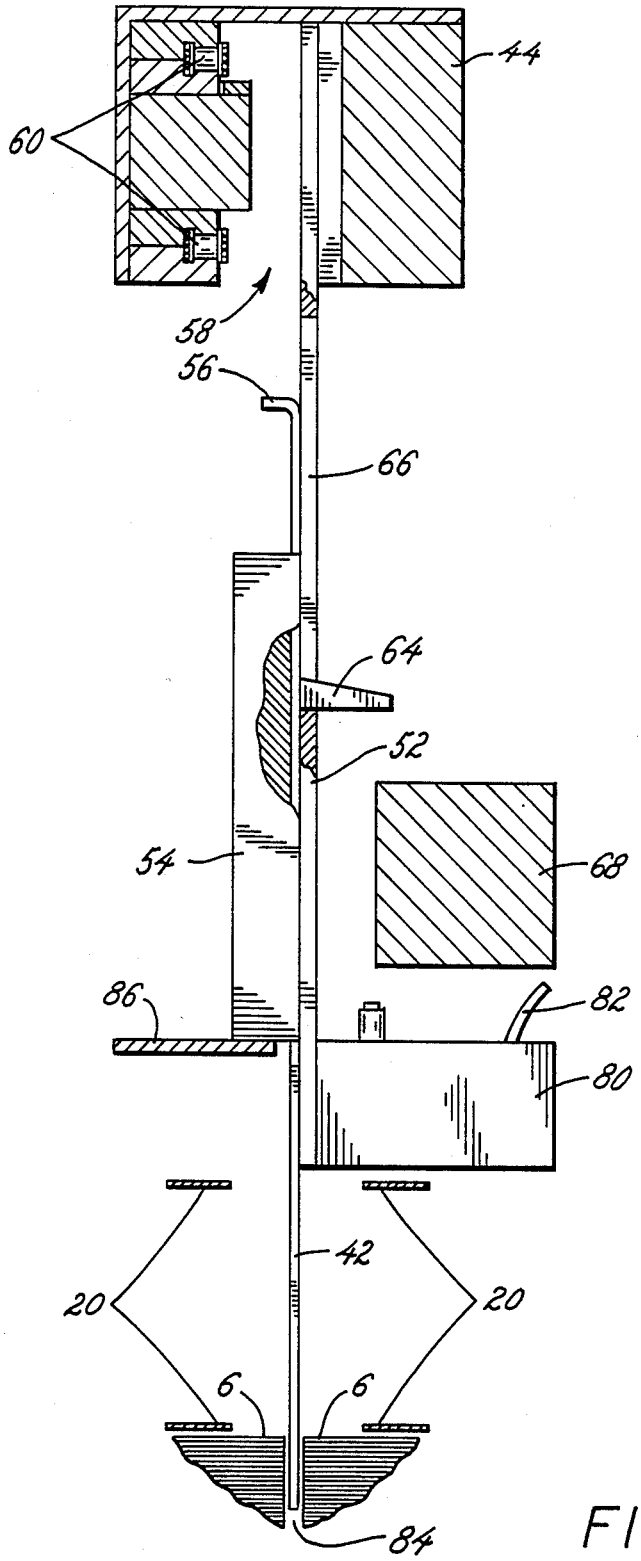
FIG. 5 is an enlarged cross-sectional view of an individual boundary plate section corresponding to section line V—V of FIG. 3, which has been lowered into its operating position in the stacking zone.

Turning now to FIGS. 4 and 5, on the support beams 44 there are mounted downward-reaching guide plates 52, one for each of the tongues 40 and 42. Adjacent to each of the guide plates 52 is a guide block 54 which provides a guide for a tongue 40 or 42 for shifting up and down. As in FIG. 4, each tongue is bent on its upper end which allows to be fitted into a recess 58 of the support beam 44. FIGS. 2 and 3 depict a longitudinally running endless roll chain 60 located in the support beam 44 with the two stringers positioned one over the other. Along part of the length of the chain 60 is attached a number of lateral continuations 62 corresponding to the position of the tongues 40 and 42, and provides a method for arresting selected tongues in their raised positions by their bends 56.

From each of the tongues 40 and 42 there extends a lateral arm 64 through a slit 66 of the corresponding guide plate 52 for limiting the downward stroke of the tongue, and also providing a means for raising the tongue to its upward position as shown in FIG. 4. When used for this latter purpose, the arm 64 rests on a spar 68 running parallel to the support beam 44. The spar 68 is guided through this upward and downward movement on two rails 70 and 72 extending down from the support beam 44 (FIGS. 1 to 3). In order to move the spar 68, a chain drive 74 indicated schematically in FIGS. 1 to 3 driven by a gear motor 76 is provided, which is in common to the spars 68 of all the support beams 44.

As shown in FIG. 5, the respective tongue 42 assumes its operating position when interposed between two adjacent stacks 6. In this case, the tongue and spar are placed in their lower end positions. When the spar 68 is raised, it engages the arm 64 and carries it into its upper position as in FIG. 4.

In order to secure selected tongues in their raised position, a stepping motor 78 is used to correspondingly shift the chain 60 so that continuations 62 come to rest underneath the bend 56 of all tongues to be secured in a raised position. As is to be most clearly seen from FIG. 3, the tongues with corresponding positioned continuations 62 will now remain arrested in their raised position, regardless of the position of the spar 68. When used in this manner, a shortened stack length may be used as shown in FIG. 3 where effective lateral boundary plate length has been shortened considerably. In this setting only a few of the tongues on the right remain in the stacking zone, and the guide blocks 28 on the rods 26 were displaced to the right to adjust for the shortened stack length. Also when in this position, the roller 30 with the sheet feed guide bands 32 and the rear contact plate 36 extend for into the zone of the tongues 40 and 42. It is now evident that the chain 60 with its continuations 62 make it possible to arrest in their raised positions all the tongues 40 and 42 that are not needed in the stacking zone, while still always allowing substantially the entire stack length to be traversed by the tongues positioned in their downward position.

As can be seen from FIGS. 4 and 5, at the lower end of the guide plate 52 which reaches down into the vicinity of the upper set of sheet guide bands 20 there is mounted a pneumatic vibrator 80 which is supplied compressed air through a tube 82 over a blocking valve (not shown). The guide plate 52 is constructed so that under the action of the vibrator 80 it vibrates in a direction perpendicular to the plate plane and transmits this vibration to the contacting tongue 42. This vibration action knocks smooth the side surfaces of the adjoining stack 6 in the stacking zone where the stack has not yet come to rest.

The tongues 40 differ from the tongues 42 only in that they are somewhat thicker and remain in a rest state (non-vibrating) such that they occupy substantially the entire gap 84 between adjacent stacks. The guide plates 52 of the thicker tongues 40 are not provided with vibrators.

Preferably, the vibrators 80 of the tongues 42 which are not in use (as indicated in FIGS. 3 and 4) will be switched off. A single vibrator 80 can be attached common to all guide blocks 54 of the corresponding tongues which are in use, as shown in FIGS. 4 and 5 where the guide blocks 54 are attached to a rail 86 mounted to their underside. The tongues are arranged such that each tongue 42 subjected to vibrations, stands next to a rigid tongue 40 and vice versa. Finally, it is suggested that the guide plates 52 of the rigid tongues 40 be constructed such that they are relatively rigid in comparison to the guide plates of the flexible tongues 42.

What is claimed is:

1. A sheet stacking device comprising a lift table automatically lowerable in correspondence to the height of a forming stack, a face-side sheet feeder, at least one stop plate positioned opposite said sheet feeder, and at least two lateral boundary plates lying opposite one another on either side of the upper end of said stack, said boundary plates being subdivided into a plurality of individual sections following one another in longitudinal direction along the sides of said stack, a first means for selectively removing and supporting one or more individual boundary plate sections remote from said stop plate at a position out of engagement with said stack, and a second means for supporting one or more individual boundary plate sections at a position in engagement with said stack, whereby the effective length of said boundary plates are adjusted so as to correspond substantially to the length of said stack.

2. A sheet stacking device according to claim 1, wherein at least said removable sections of said boundary plates are constructed as tongues which reach downward from said second means when used to stack sheets and which are arrestable in a raised position by said first means when not used to stack sheets.

3. A sheet stacking device according to claim 2, wherein said tongues are arranged with continuously equal division.

4. A sheet stacking device according to claim 2, wherein said first means includes a longitudinally shiftable chain from which said raised tongues may be suspended.

5. A sheet stacking device according to claim 3, wherein said means includes a longitudinally shiftable chain from which said raised tongues may be suspended.

6. A sheet stacking device according to claim 5, wherein said chain is an endless chain and presents on part of its length a number of holding lugs with division corresponding to said tongue division for said tongues to be arrested in a raised position.

7. A sheet stacking device according to claim 5, wherein said chain is drivable by a stepper motor with a step length corresponding to said tongue division.

8. A sheet stacking device according to claim 6, wherein said chain is drivable by a stepper motor with a step length corresponding to said tongue division.

9. A sheet stacking device according to claim 1, wherein at least individual ones of said boundary plate sections may be coupled with a shaking drive and subjected to shaking movements.

10. A sheet stacking device according to claim 9, wherein between successive said boundary plates sections subjected to shaking movements there may be arranged rigid sections.

11. A sheet stacking device according to claim 10, wherein opposite each said boundary plate section subjected to shaking movements on one side of said stack there stands a said rigid section on the other side of said stack.

12. A sheet stacking device according to claim 10, wherein said rigid sections are thicker than said sections subjected to shaking movements.

13. A sheet stacking device according to claim 11, wherein said rigid sections are thicker than said sections subjected to shaking movements.

* * * * *